US006007779A

United States Patent [19]

Lemieux et al.

[11] Patent Number: 6,007,779

[45] **Date of Patent: *Dec. 28, 1999**

[54] REFILL PACK FOR PIPETTE TIP RACKS

[75] Inventors: David J. Lemieux, Middleton, Mass.; William D. Homberg, Oakland, Calif.; Christopher Kelly, Larkspur, Calif.; Kent G. Moriarty, Pinole, Calif.

[73] Assignee: Rainin Instrument Co., Inc., Emeryville, Calif.

[ * ] Notice: This patent is subject to a terminal disclaimer.

[21] Appl. No.: 08/819,795

[22] Filed: Mar. 18, 1997

Related U.S. Application Data

[63] Continuation-in-part of application No. 08/492,776, Jun. 21, 1995, Pat. No. 5,612,000, which is a continuation of application No. 08/125,019, Sep. 21, 1993, Pat. No. 5,441,702.

[51] Int. Cl.[6] ..... B01L 3/02; B65D 55/00

[52] U.S. Cl. ..... 422/100; 422/104; 206/499; 206/503; 206/506; 206/507; 206/563

[58] Field of Search ..... 422/100.99, 104; 206/562, 499, 503, 506, 507, 563

[56] References Cited

FOREIGN PATENT DOCUMENTS

96/07480 3/1996 WIPO .

*Primary Examiner*—Long V. Le
*Attorney, Agent, or Firm*—Robert R. Meads

[57] ABSTRACT

A refill pack for storing and dispensing pipette tips into an empty tip rack. The refill rack comprises a hand-gripable carrier for an array of pipette tips releasably secured relative to the carrier such that after hand positioning the array of tips on the empty tip rack, the carrier may be released from the tips which are then free to be seated on a lower end of a pipette and removed from the tip rack.

9 Claims, 3 Drawing Sheets

REFILL PACK FOR PIPETTE TIP RACKS

RELATED PATENT APPLICATION

This application is a continuation-in-part of Ser. No. 08/492,776 filed Jun. 21, 1995 now U.S. Pat. No. 5,612,200 issued Mar. 18, 1997, which is continuation of Ser. No. 08/125,019, filed Sep. 21, 1993, now U.S. Pat. No. 5,441,702 issued Aug. 15, 1995.

FIELD OF INVENTION

The present invention relates to the refilling of pipette tip racks and, more particularly to a disposable refill pack of pipette tips for reusable pipette tip racks.

BACKGROUND OF THE INVENTION

It is the function of pipette tip racks to organize disposable pipette tips in a manner for convenient tip placement on a pipette. Such racks generally comprise a base with vertical sides joined at contiguous edges and containing supports for a rigid horizontal tray or support plate containing an array of holes for vertically receiving and supporting a horizontally spaced array of pipette tips. The pipette tips are held vertically in the array for ease of access by a pipette tip user. In this regard, the pipette tip user simply moves a hand-holdable pipette over the rack and lowers a distal end of the pipette into a proximal or upper end of a vertically oriented tip and presses down to affix the tip to the pipette. A similar operation is followed by the user when connecting a plurality of tips to a multiple tip pipette. U.S. Pat. No. 4,676,377 describes a conventional pipette tip rack of the type just described, and U.S. Pat. No. 4,779,467 describes a multiple tip pipette.

Once all tips are dispensed from the tip rack, the rack may be discarded or reloaded with a new supply of pipette tips. The reloading of disposable pipette tips into such tip racks in a rapid, convenient manner is important to pipette users. Further, any packaging containing pipette tips and for use in loading pipette tips into a tip rack should arrange the pipette tips in a manner to accommodate direct dispensing of the tips into standard tip rack arrangements. Moreover, it is important that such packaging protect the disposable pipette tips from damage and contamination during shipping, handling and storage and provide for sterilization by autoclaving or irradiation of the pipette tips. Still further, when plastic materials are utilized for such packaging, it is particularly important to the preservation of our environment (1) that the plastic material be recyclable and (2) that the packaging structure be thin, lightweight and of low mass to minimize the amount of non-biodegradable disposable material from such packaging. Furthermore, there is a need for refill packs for manually reloading reusable pipette tip racks with filter containing pipette tips such as the FilterPro of the Rainin Instrument Co., Inc., assignee of the present invention, or, such as the filter devices described in U.S. Pat. No. 5,156,811, assigned to Continental Laboratory Products, Inc. of San Diego, Calif.

Prior packaging used for stacks of pipette tip racks and for pipette tips for reloading empty pipette tip racks do not satisfy such requirements. For example, U.S. Pat. No. 3,853,217 describes a stack of stand-alone pipette tip racks, referred to in the patent as "trays". Each tray comprises a horizontally oriented rectangular support. The horizontal support contains transverse stiffening ribs. Each rib extends above the horizontal support and terminates in marginal vertical sides. The sides extend above and below the horizontal support and connect at their contiguous edges to form a skirt. The skirt extends below distal end portions of vertical pipette tips contained in a honeycomb array of openings in the horizontal surface. A shoulder is formed around the skirt so as to accept and support an identical upper tray to rest a lowermost edge of its skirt for stacking of the trays. The shoulder thereby spaces the upper tray so as to allow the distal end portion of the pipette tips in the upper tray to extend into the open proximal end of the pipette tips in the lower tray. Concentric positioning of the upper tips in the lower tips permits a nested stacking of multiple trays. A cover encloses the topmost tray in the stack. Tape is used to secure the cover and stacked trays; applied to fasten the cover and trays along common sides. Nested stacks of the trays with a cover are enclosed within a snug carton for shipping and storage. Additionally, folded sleeves are included in the shipping carton for covering a tray removed from the stack. The carton is provided with a pipette tip extractor for collecting used tips in the shipping carton. The trays are structurally rigid and with sufficient material thickness to be self supporting. The rigid trays are used individually and stored as stacked.

In use, the stacked trays with the cover taped in place are removed from the shipping carton. Individual trays are removed from the bottom of the stack by severing the tape attaching the lowest tray, leaving the upper trays attached and enclosed until the next bottom tray is to be used. The pipette tips are accessed individually from the tray, since the honeycomb arrangement does not accommodate multiple tip pipettes. Used pipette tips are disposed of in the shipping carton, using the tip extractor included. As each tray is emptied, it is discarded. Since the trays are intended for stand-alone use, their structure is necessarily heavy, with thick stiffening sections, containing a significant amount of plastic. Therefore, the heavy trays represent a significant environmental disposal problem. Further, the nesting of the trays with upper pipette tips extending into lower tips, precludes the use of the package of U.S. Pat. No. 3,853,217 for storage and dispensing of filter containing pipette tips.

In U.S. Pat. No. 3,937,322, a package containing a stack of trays of pipette tips is disclosed. Each tray comprises a horizontal rectangular support with an array of openings. The openings accept distal end portions of pipette tips and maintain their longitudinal axes in a vertical orientation. The trays are stacked in a carton by telescoping the pipette tips carried by an upper tray into the open upper ends of the pipette tips carried by the next lower tray and by resting a horizontal support lower surface of the upper tray on the upper edge of the pipette tips in the next lower tray. The lowermost tray in the stack is supported on a tray support extending vertically from a bottom of the carton. Also attached to the carton is a pipette tip extractor.

In use, the carton is opened at the top and uppermost pipette tip trays are exposed. The pipette tips are accessed from the open top of the carton and individually loaded onto pipettes. This is accomplished by pressing an end of a pipette into a tip to seat the tip thereon and then by removing the loaded pipette from the carton. When all the pipette tips on the uppermost tray have been thus dispensed from the tray, the tray is discarded, exposing the tips in the tray below. The pipette tip extractor is installed in a wall of the carton and permits a used tip to be extracted from the pipette and dropped into the carton without contact with the user. The carton is then used for disposal of used tips.

As described, the container of U.S. Pat. No. 3,937,322 is characterized by a number of shortcomings. Because of the telescoping of the pipette tips in the stack of trays, it is not possible to use the packaging of the '322 patent for the storage and dispensing of filter containing tips. Further, for one of the contained pipette tips to be accessible to a user for reloading of a pipette, substantially all the contained pipette tips are exposed to the atmosphere and hence subject to possible contamination. Finally, each tray is supported on the tops of the pipette tips in the next lower tray. Unless the trays and the bottom tray support are formed of relatively heavy, rigid plastic or equivalent material, the downward pressing of the pipette in loading a tip onto the shaft of a pipette will produce an undesired downward bowing of the trays. The bowing of the tray makes it difficult to insert a pipette tip onto the end of a pipette shaft. In the case of a multiple-tip pipette, only a small amount of bowing is required to prevent a user from being able to insert pipette tips simultaneously onto all shafts of the multiple-tip pipette simply by pressing down on the pipette. Rather, if the tray bows, a user must (i) check each tip individually in order to assure that all tips are properly secured to each pipette shaft and (ii) secure any loose tips individually by hand. With a heavier, more rigid rack support, such bowing will not occur. However, if the trays and the bottom tray support are formed of a heavy rigid plastic material to prevent such undesired bowing during the loading of pipettes, then the disposal of such trays will present an undesired increase in the disposal of non-biodegradable materials.

Prior commercially available packaging of stacks of nested pipette tip racks similar to the packaging disclosed by the U.S. Pat. No. 3,853,217 and possessing all the disadvantages thereof is represented by the RBR Packaging of Bio-Rad Laboratories, Inc. of Richmond, Calif. TBR Packaging comprising a stack of separate racks is also available from Bio-Rad Laboratories, Inc. In addition, USA/Scientific Plastics of Ocala, Fla. markets a RE-PACK RACK comprising a reusable pipette tip rack, designed to accept RE-PACK Tray Cartridges preloaded with 192 pipette tips per tray. Once a tray is empty, it is simply removed from the rack and discarded and another tray cartridge inserted in its place. The RE-PACK Tray Cartridges are formed of a rigid, relatively heavy plastic construction and, but for the transverse ribs, resemble and possess the disadvantages of the trays disclosed in U.S. Pat. No. 3,853,217. Such RE-PACK tray cartridges are available in shrink-wrapped stacks of 5 trays of 192 tips each.

From the foregoing, it should be appreciated that prior packages for pipette tip racks and trays do not satisfy the previously stated desired requirements for packaging for reloading of disposable pipette tips into reusable tip racks. Thus, there is a continuing need for such packaging which is satisfied by this present invention.

SUMMARY OF THE INVENTION

In its most basic form, the present invention provides a simple, light weight, low cost and disposable or recyclable refill pack for reusable pipette tip racks in which pipette tips are contained with their longitudinal axes vertically positioned in a horizontally spaced pattern or array. The refill pack comprises (i) a horizontally extending pipette tip organizing and support plate, (ii) a light weight handgripable support plate carrier, and (iii) manually releasable means for dispensing pipette tips from the refill pack into an empty tip rack. The support plate includes an array of holes for vertically receiving and organizing pipette tips in a desired pattern for deposit into and containment within an empty tip rack. Distal end portions of the pipette tips extend vertically through the holes on one side of the support plate while proximal end portions of the pipette tips are supported by the plate on an opposite side thereof. The carrier is secured to the support plate and enables a user to manually move and position the support plate over an empty tip rack while the support plate maintains the horizontal spacing and vertical orientation of the pipette tips within the refill pack ready for dispensing into the tip rack upon a release of the tips from the refill pack. Thus, in use, a user hand grips the carrier and lifts and moves the array of pipette tips over and down onto the top of an empty tip rack until the distal ends of the pipette tips seat in an array of holes in a support tray of the tip rack. The user then releases the array of tips from the carrier readying the tips for seating on and pick up by a lower end of a pipette.

Preferred embodiments are presented setting forth details referred to and illustrated in the drawings described below. The variations of the invention hereinafter described may be packaged separately or with a pipette tip rack.

BRIEF DESCRIPTION OF THE DRAWINGS

FIG. 2 also depicts a plurality of carrier plates above the organizing plate within the carrier and each supporting an array of pipette tips. The pipette tips in the array supported by the lowermost carrier plate telescope into corresponding tips in the array supported by the organizing plate. Similarly, the pipette tips supported by each of the other carrier plates telescope into the next lower array of tips to form a stack of telescoping arrays of pipette tips within the carrier.

FIG. 7*a* shows the laterally extending latch arm of the illustrated mechanism engaging and supporting the underside of an organizing plate for a plurality of pipette tips. FIG. 7*b* is similar to FIG. 7*a* and shows the carrier positioned over an empty pipette rack with a sidewall of the rack engaging and swinging the latch upward to release the organizing plate allowing the organizing plate and the plurality of pipette tips supported to drop onto a support tray of the rack. FIG. 7*c* shows the carrier raised from the tip rack and the latch arm returned to its laterally extending position to engage and support the underside of a carrier plate for a next plurality of pipette tips supported in the carrier.

DESCRIPTION OF THE PREFERRED EMBODIMENTS

The present invention provides a novel refill pack of disposable pipette tips for reusable pipette tip racks and may take any of a multiplicity of forms within the claims hereafter presented. Each embodiment may include or exclude a tip rack as part of the refill pack. Additionally, the materials for use in the present invention may be selected as appropriate for sterilization by autoclaving or irradiation and to permit recycling for minimizing detrimental environmental impact.

Figure 1A:
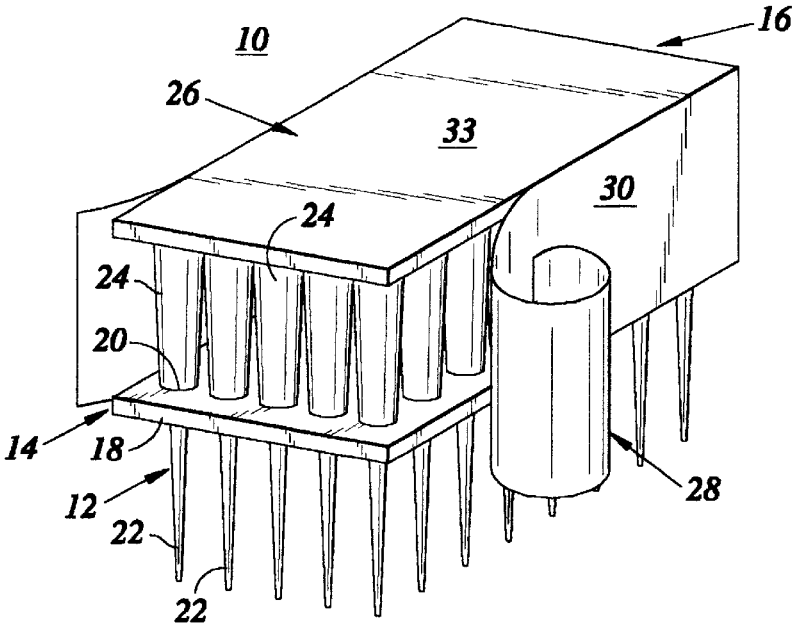
FIG. 1*a* is an isometric view of a basic and simple embodiment of a single array pipette tip refill pack showing the use of tape as releasable means for releasably securing a support plate for an array of pipette tips to a carrier comprising a cover or top plate for the array.

More particularly, a simplified form of a single array refill pack 10 is shown in FIG. 1*a* and comprises a pipette tip organizing means 14 for an array of pipette tips 12 in combination with a hand gripable carrier 16 for the organizing means 14.

As illustrated, the organizing means 14 comprises a semi-rigid plastic support plate 18 having an array of holes 20 for (i) receiving distal end portions 22 of the pipette tips 12 and (ii) organizing the pipette tips 12 into a horizontally spaced array. The array of pipette tips 12, which may comprise filter containing pipette tips, has distal end portions 22 extending perpendicularly through the holes 20 in the support plate 18 and proximal end portions 24 extending perpendicularly from the opposite surface of the support plate 18.

As also illustrated in the embodiment of FIG. 1*a*, the carrier 16 comprises a cover 26 secured by releasable means 28 to the support plate 18. The illustrated cover 26 comprises an alignment plate 33 which rests on and confines the proximal end portions 24 of the pipette tips 12 in combination with the support plate 18.

The releasable means 28 of FIG. 1*a* comprises a tape 30 of sufficient vertical dimension and length to extend between and around and to adhesively, thermally or mechanically attach to marginal edges of the support plate 18 comprising the organizing means 14 and marginal edges of the alignment plate 33 comprising the carrier 16.

To protect the distal end portions 22 of the array of pipette tips 12 and to complete the packaging for the refill pack 10, the refill pack may be enclosed by shrink wrap or within a pouch or other container or box of a thin light weight recyclable plastic or cardboard material. Then, in use, the refill pack is removed from the shrink wrap, pouch or box. Next, the user of the refill pack grips the alignment plate 33 comprising the carrier 16, moves the pack 10 over the top of any empty tip rack, and lowers the carrier to insert the distal end portions of the array of pipette tips 12 into the open top of the rack. He then releases the tape 30 to separate the carrier 16 from the array of pipette tips 12 as well as the support plate 18 which remain in the tip rack. Finally, the alignment plate 33 comprising the carrier is removed and may be recycled, as may the support plate after all of the pipette tips are dispensed from the tip rack.

Figure 1B:
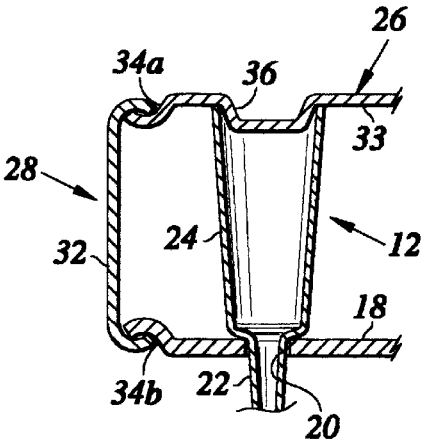
FIG. 1*b* is a partial section end view of the single array refill pack of FIG. 1*a* with the tape replaced by spring clips.

An alternate form of the refill pack 10 is shown in FIG. 1*b*. As illustrated, instead of comprising a length of tape, the releasable means 28 comprises plastic or metal spring clips 32 or other spring attachment means, releasably securing the carrier 16 and the support plate 18. In the illustrated alternative, the alignment plate 33 includes a downwardly extending marginal channel 34*a* formed so as to accept the spring clip 32 with its uppermost surface flush with the upper surface of the alignment plate 33. Similarly, to accept the lower portion of the spring clip 32, the support plate 18 contains an upwardly extending marginal channel 34*b* formed so as to retain the spring clip lowermost surface flush with the lower surface of the support plate 18.

In addition, in the alternative form of the refill pack illustrated in FIG. 1*b*, an array of frusto-conical projections 36 extend downwardly from a bottom of the alignment plate 33. The array of projections 36 correspond to and align vertically with the array of holes in the support plate 18 and define indexing means extending into and laterally constraining proximal end portions 24 of pipette tips 12 to maintain the longitudinal axes of the pipette tips 12 in a vertical orientation.

In use, the spring clips 32 releasably secure the support plate 18 relative to the alignment plate 33 whereby a manual positioning of the support plate 18 over a pipette tip rack 38 with the distal end portions 22 of the pipette tips 12 extending into the pipette tip rack 38 followed by a release of the spring clips and removal of the alignment plate 33 affects a refilling of the pipette tip rack.

From the foregoing description of the embodiments illustrated in FIGS. 1*a* and 1*b*, it should be appreciated that the present invention may take many various forms. For example, the hand grippable carrier described above may comprise a tubular housing or carrier having an open lower end and an open upper end. Such tubular carriers for supporting the organizing or support plate, and a plurality of carrier plates each supporting an array of pipette tips are described by way of example in the parent patent application, now U.S. Pat. No. 5,441,702, which is hereby incorporated by reference.

Specifically, referring to the U.S. Pat. No. 5,441,702, FIG. 10 thereof depicts a stacked multiple array refill pack comprising a vertical tubular container formed of a light weight plastic material and housing an organizing plate and a plurality of carrier plates. The organizing plate and carrier plates each include an identical array of holes corresponding to the array of holes in an organizing tray of an empty pipette tip rack. Arrays of pipette tips are supported in the holes and each of the organizing plate and carrier plates.

As shown in FIG. 10 of the patent, when the carrier is positioned over an empty pipette tip rack, distal end portions of a lowermost array of pipette tips supported by the organizing plate extend into corresponding holes in the tray of the tip rack. Also, as shown in FIG. 10 of the patent, corresponding pipette tips in the array carried by the lowermost carrier plate telescope into proximal end portions of the pipette tips carried by the organizing plate. Similarly, the distal end portions of the pipettes of each of the arrays supported by each of the other carrier plates telescope into proximal end portions of the corresponding pipette tips supported by the next lower carrier plate.

To refill the empty tip rack, a user simply places the carrier over the tip rack and presses on a push plate bearing on the proximal end of the pipette tips carried by the uppermost carrier plate. This forces the stacked arrays of telescoping pipette tips and their associated carrier plates downwardly within the carrier. This, in turn and causes the organizing plate to move over inward projections in opposing side walls of the carrier adjacent the lower open end thereof to cause the adjacent portions of the side walls of the carrier to flex slightly outward. This releases the organizing plate and the array of pipette tips supported thereby downwardly onto the top of the organizing tray in the pipette tip rack to refill the tip rack. After the organizing plate passes the projections, the side walls of the carrier return to their normal position and the projections then engage the under side of the lowermost carrier plate to support the stack of arrays of pipette tips and carrier plates within the carrier, the under side of each of the carrier plates above the lowermost carrier plates resting on the proximal end of the pipette tips supported by the next lower carrier plate.

Each of FIGS. 2–6 and 7*a*, 7*b*, and 7*c* diagrammatically depict alternative embodiments of such a stacked multiple array refill pack including different release mechanisms for the organizing plate and carrier plates in dispensing arrays of pipette tips from the carrier into empty pipette tip racks. Each such alternative embodiment comprises cooperative means on the organizing plate and the carrier for releasably securing the organizing plate and subsequently each individual carrier plate in the carrier for release with the plurality of pipette tips supported thereby from the carrier through the open bottom of the carrier and into an empty pipette tip rack upon an actuation of the cooperative means by a user of the refill pack.

Figure 2:
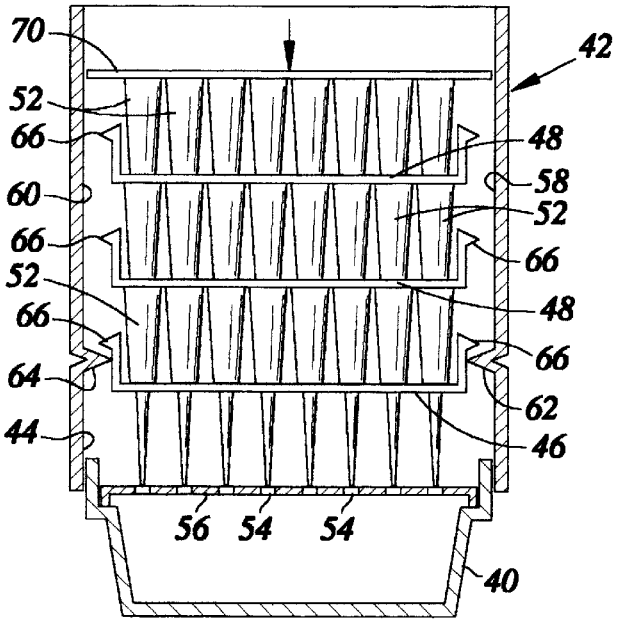
FIG. 2 is a diagrammatic side view of a first alternative embodiment of the present invention including an organizing plate for supporting an array of pipette tips within a lower open end of a tubular carrier, the organizing plate including moveable members for releasing the organizing plate from the carrier through the lower open end to deposit the array of pipette tips in an empty pipette tip rack.

In particular, FIG. 2 diagrammatically depicts a refill pack 38 over an empty pipette tip rack 40. The refill pack 38 comprises a tubular carrier 42 having a lower open end 44 and containing an organizing plate 46 and a plurality of identical carrier plates 48, each plate having an array of holes 50 (see FIG. 6) receiving a plurality of pipette tips 52. The arrays of holes 50 in each of the plates (46, 48) match an array of holes 54 in the support tray 56 of the pipette tip rack 40 such that the distal end of each pipette tip 48 in the refill pack 38 telescopes into an open proximal end of a next lower pipette tip 48 carried by the next lower plate. As depicted, opposing inner side walls 58 and 60 of the tubular carrier 42 include inwardly facing projections 62 and 64 adjacent the lower open end 44 of the carrier 42. The projections 62 and 64 are adapted to engage outwardly extending portions of vertically extending arms 66 and 68 respectively. The arms 66 and 68 extend from opposing sides of the organizing plate 46 as depicted. Thus, as represented, the projections 62 and 64 horizontially support the organizing plant over the lower open end 44 of the carrier 42. Due to the telescoping structure of the carrier plates and arrays of pipette tips supported thereby, the projections 62 and 64 also provide vertical support for each of the carrier plates and pipette tip arrays. In this regard as in the embodiment of FIG. 10 of U.S. Pat. No. 5,441,702, each carrier plate rests on top of the proximal end of the tips in the array supported by the next lower carrier or organizing plate.

In the embodiment of FIG. 2, the arms 66 and 68 are moveable by being either deformable or resilient such that in response to a downward force applied by a user pressing on a push plate 70 resting on the uppermost array of tips, the arms 66 and 68 of the organizing plate flex, bend or move inwardly to pass over the projections 62, 64 on the carrier 42 to allow the organizing plate 46 and the plurality of pipette tips 52 supported thereby to drop through the lower open end 44 of the carrier 42 and onto the tray 56 of the empty pipette tip rack 40. Since, as illustrated, each carrier plate 48 is identical in structure to the organizing plate 46, (each including arms 66 and 68), with such downward movement, the arms of the lowermost carrier plate engage the projection 62, 64 readying the array of pipette tips supported thereby for dispensing into the same or a different empty pipette tip rack in response to further downward force applied to the push plate 70.

In FIGS. 3 through 6 and 7*a*, 7*b*, 7*c*, embodiments of a refill pack similar to FIG. 2 but including latch type release mechanisms are illustrated over empty pipette tip racks. For example, in FIG. 3, the tubular carrier 42 includes user operable release latches 72 and 74 on the opposing sidewalls 58 and 60 instead of the projections 62, 64 and arms 66, 68 defining cooperative release means for the organizing and carrier plates 46, 48. Each latch includes an inwardly extending latch member 76 supported by a hinge 78 to an associated one of the sidewalls of the carrier 42 for engaging an under surface of the organizing plate 46 as illustrated. Upon manual rotating of the members 76, (as depicted by the arrows), the latches release from the under surface of the organizing plate allowing the plate and the array of pipette tips supported thereby to drop through the lower open end 44 of the carrier 42 and into an empty rack 40. After reloading of the tip rack, the latches are returned to their original position to support the lowermost carrier plate 48 and the array of pipette tips 52 supported thereby.

Figure 3:
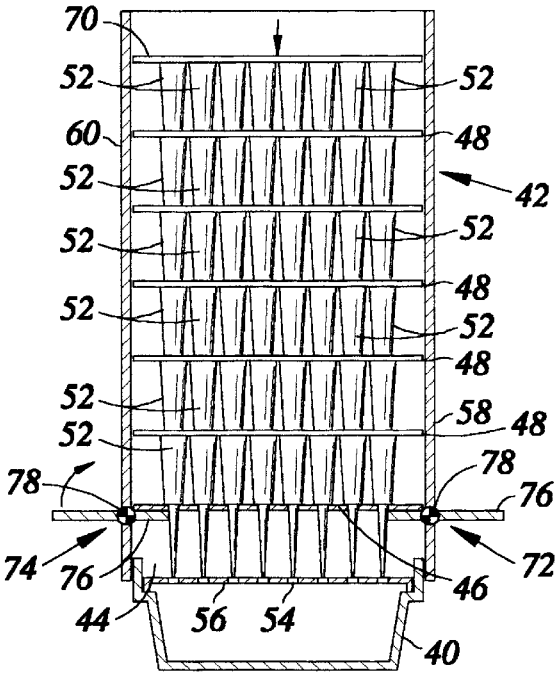
FIG. 3 is a diagrammatic side view of a second alternative embodiment of the present invention similar to FIG. 2 and including an organizing plate for supporting an array of pipette tips within a lower open end of a tubular carrier, the organizing plate being supported by latches extending from opposing sidewalls of the carrier for user actuation to release the organizing plate and array of pipette tips from the carrier through the lower open end thereof.
Figure 4:
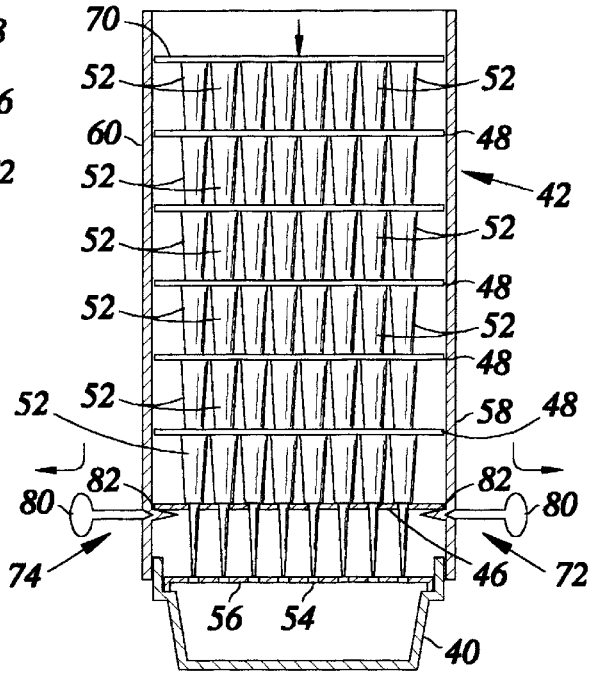
FIG. 4 is a diagrammatic side view of a third alternative embodiment of the present invention similar to FIG. 3 wherein each latch comprises user operable pull tab.

The alternative embodiment of FIG. 4 is similar to FIG. 3 except that instead of including hinges, the latches 72 and 74 each include an outwardly extending pull tab 80 connected to inwardly extending projection 82 in a sidewall (58, 60) of the carrier 42 for engaging the underside of the organizing plate 46 as illustrated. To release the latches of FIG. 4, the user simply pulls outwardly on the tabs 80 to outwardly flex opposing sidewalls of the carrier allowing the organizing plate and the array of tips 52 supported thereby to drop through the lower open end 44 of the carrier into the empty pipette tip rack 40. A release of the pull tabs 80 automatically returns the projections 82 under the lowermost carrier plate 48 readying the refill pack for subsequent operation as described above to release the lowermost carrier plate and the array of pipette tips carried thereby into another empty pipette tip rack.

Figure 5:
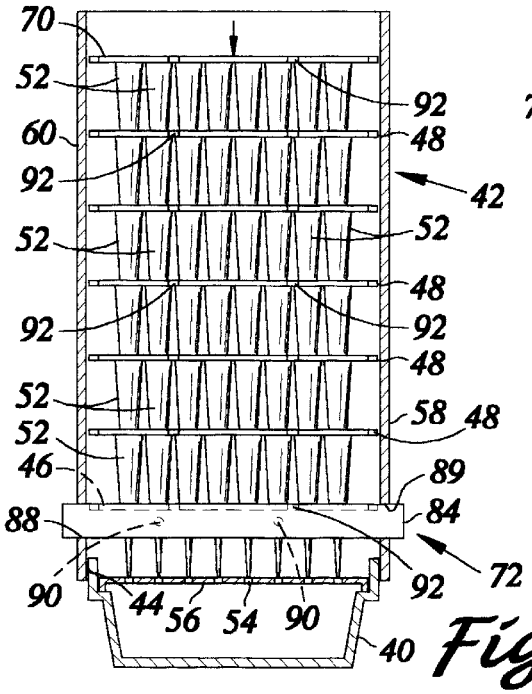
FIG. 5 is a diagrammatic side view of a fourth alternative embodiment of the present invention similar to FIGS. 3 and 4 wherein the release for the organizing plate comprises a pair of laterally moveable slide members carrying protrusions for aligning with vertical slots in opposing edges of the organizing plate to allow the organizing plate to release from the carrier and the array of pipette tips supported thereby to drop through the open end of the carrier into an empty pipette tip rack.
Figure 6:
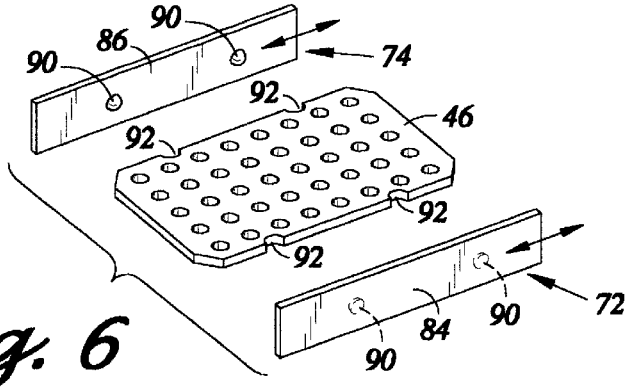
FIG. 6 is a diagrammatic prospective and exploded view of the combination of the organizing plate and two slide members included in the embodiment of FIG. 5.

In the alternative embodiments of FIGS. 5 and 6, the latches 72 and 74 are diagrammatically illustrated as comprising slide members 84 and 86 supported in opposing vertically extending slots 88 in sidewalls 58 and 60 of the tubular carrier. Each slide member carries two or more protrusions 90 extending inwardly within the carrier 42 to engage an underside of an horizontially support the organizing plate 46 within the carrier over the lower open end 44. Front and back marginal edges of the organizing plate 46 include matching horizontally spaced vertical slots 92 for aligning with and vertically receiving to projections 90. Thus, when the slide members 84 and 86 are positioned as shown in FIG. 5, the protrusions engage the under surface of the organizing plate 46 to secure the organizing plate and the stack of carrier plates 46 within the carrier 42. Then, when it is desired to release the organizing plate 46 and the array of tips 52 supported thereby, a user simply slides the slide members to move the protrusions 90 into alignment with the slots 92 in the side of the organizing plate to allow the organizing plate to move vertically downward through the open bottom 44 of the carrier 42 to deposit the array of pipette tips 52 supported thereby in the empty pipette tip rack 40 located below the tubular carrier. After release of the organizing plate from the carrier 42, the user slides the slide members back to the position shown in FIG. 5 to secure the lowermost carrier plate 48 within the carrier 42 for subsequent release in the same manner as described for the organizing plate.

Figure 7A:
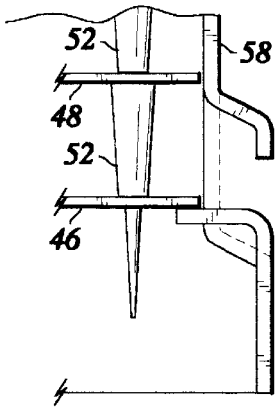
FIG. 7*a*, FIG. 7*b* and FIG. 7*c* are diagrammatic side views of a portion of a fifth embodiment of the present invention similar to FIG. 3 illustrating one of the latch mechanisms included in opposing sidewalls of the tubular carrier of the embodiment.
Figure 7B:
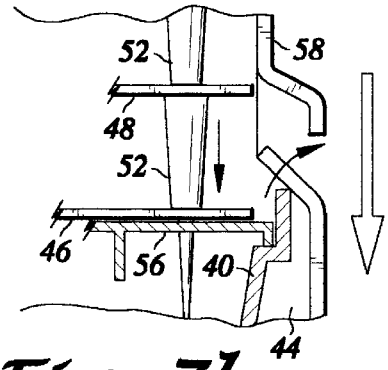
Figure 7C:
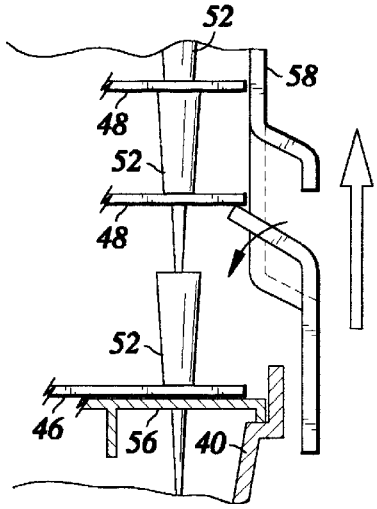

Finally, FIGS. 7*a*, 7*b* and 7*c* illustrate a similar refill pack wherein the latches 72 and 74 each comprise a resilient latch are formed in and extending inwardly from a sidewall (58, 60) of the tubular carrier 42 for engaging and vertically supporting the under side of the organizing plate 46 contained within the carrier. This is most clearly illustrated in FIG. 7*a*. The arm 94 of each latch extends upwardly and inwardly from its associated sidewall and is designed to engage an upwardly extending side of the empty pipette tip rack 40 when the carrier 42 is positioned thereover, as shown most clearly in FIG. 7*b*. As the vertical side of the tip rack 40 engages the arm, the arm moves upwardly and outwardly effecting a release of the organizing plate and the array of pipette tips 52 supported thereby downward through the open bottom 44 of the carrier and onto the tray 56 of the tip rack as illustrated in FIG. 6*b*. Then, when the tubular carrier 42 is moved upwardly as shown in FIG. 7*c*, the arm 94 of each latch returns to its initial horizontal position engaging the underside of the lowermost carrier plate allowing the carrier 42 to lift the stack of carrier plates and arrays of pipette tips with the refill pack from the pipette tip rack for placement over another empty pipette tip rack in order that the refill operation just described and illustrated in FIG. 7*a*, 7*b*, and 7*c* may be repeated.

In view of the foregoing alternatives, it should be clear that the present invention is to be limited in scope only by the following claims.

We claim:

1. A refill pack for refilling an empty pipette tip rack, comprising:

an organizing plate including an array of holes;

a plurality of pipette tips with distal end portions extending vertically through the array of holes in the organizing plate for support in a horizontally spaced array;

a vertically extending tubular carrier having a lower open end for receiving the organizing plate to vertically support the plurality of pipette tips within the carrier; and cooperative means on and between the carrier and the organizing plate and comprising moveable means on the organizing plate for releaseably securing the organizing plate in the carrier for release with the plurality of pipette tips from the carrier through the open bottom upon an actuation of the cooperative means.

2. The refill pack of claim 1 wherein the cooperative means further include projections extending inwardly from an inside of the tubular carrier for engaging the moveable means to releasably secure the organizing plate within the carrier.

3. The refill pack of claim 2 wherein the movable means comprises arms extending vertically from the organizing plate.

4. The refill pack of claim 3 wherein the arms are resilient.

5. The refill pack of claim 3 wherein the arms are inwardly deformable.

6. A refill pack for refilling an empty pipette tip rack, comprising:

an organizing plate including an array of holes;

a plurality of pipette tips with distal end portions extending vertically through the array of holes in the organizing plate for support in a horizontally spaced array;

a vertically extending tubular carrier having a lower open end for receiving the organizing plate to vertically support the plurality of pipette tips within the carrier; and cooperative means on and between the carrier and the organizing plate and comprising latch means on the carrier for releaseably engaging the organizing plate to secure the organizing plate within the open lower end of the carrier and for operation to release the organizing plate and the plurality of pipette tips from the carrier through the open lower open end.

7. The refill pack of claim 6 wherein the latch means comprises a pair of latches on opposing side walls of the carrier and including movable arms hinged to the carrier for engaging an under side of the organizing plate to support the organizing plate within the carrier and for swinging downwardly upon user operation of the latches to release the organizing plate and the plurality of pipette tips from the carrier through the lower open end.

8. The refill pack of claim 6 wherein the latch means comprises latch members extending from opposing side walls of the carrier to engage an underside of the organizing plate to support the organizing plate within the carrier and including tabs extending outwardly from the latch members for user pulling of the latch members outwardly to release the organizing plate and the plurality of tips from the carrier through the lower open end.

9. The refill pack of claim 6 wherein the latch means comprises slides extending laterally through the carrier under and along opposing sides of the organizing plate with projection engaging the under side of the organizing plate to support the organizing plate within the carrier and the organizing plate including vertically extending slots in opposing sides for mating with the projections as the slides are laterally moved by a user to release the organizing plate from the slides through the lower open end.

* * * * *